US005272295A

United States Patent [19]

Sawada et al.

[11] Patent Number: 5,272,295

[45] Date of Patent: Dec. 21, 1993

[54] ELECTRIC CONTACT AND METHOD FOR PRODUCING THE SAME

[75] Inventors: Kazuo Sawada, Osaka; Atsushi Nakamura, Hisai; Isao Okugawa, Suzuka, all of Japan

[73] Assignees: Sumitomo Electric Industries, Ltd., Osaka; Sumitomo Wiring Systems, Ltd., Mie, both of Japan

[21] Appl. No.: 824,052

[22] Filed: Jan. 23, 1992

[30] Foreign Application Priority Data

| | | | |
|---|---|---|---|
| Jan. 23, 1991 | [JP] | Japan | 3-006490 |
| Jan. 23, 1991 | [JP] | Japan | 3-006491 |
| Jan. 23, 1991 | [JP] | Japan | 3-006492 |
| Mar. 12, 1991 | [JP] | Japan | 3-046761 |
| Mar. 12, 1991 | [JP] | Japan | 3-046762 |

[51] Int. Cl.[5] ..... H01H 1/02

[52] U.S. Cl. ..... 200/267; 200/265; 200/268

[58] Field of Search ..... 200/262, 263, 264, 265, 200/267, 268, 269; 29/25.42, 874, 825; 204/286

[56] References Cited

U.S. PATENT DOCUMENTS

| | | | |
|---|---|---|---|
| 4,345,130 | 8/1982 | Okutomi et al. | 200/268 |
| 4,450,061 | 5/1984 | Rolf | 204/286 |
| 4,547,640 | 10/1985 | Kashiwagi et al. | 200/268 X |
| 4,641,002 | 2/1987 | Maixner et al. | 200/268 |
| 4,668,375 | 5/1987 | Kato et al. | 200/268 X |
| 4,680,438 | 7/1987 | Witting et al. | 200/268 |
| 4,982,309 | 1/1991 | Shepherd | 29/25.42 X |

FOREIGN PATENT DOCUMENTS

| | | | |
|---|---|---|---|
| 1064335 | 12/1983 | U.S.S.R. | 200/262 |
| 11107184 | 8/1984 | U.S.S.R. | 200/262 |

*Primary Examiner*—Henry J. Recla
*Assistant Examiner*—Glenn T. Barrett
*Attorney, Agent, or Firm*—Sughrue, Mion, Zinn, Macpeak & Seas

[57] ABSTRACT

An electric contact is provided on at least one of a pair of conductors and includes a surface which is coated with a ceramic layer comprising at least one material selected from the group consisting of nitrides, carbides and borides of high melting point metals, this electric contact having a low contact resistance and good reliability.

17 Claims, 5 Drawing Sheets

ELECTRIC CONTACT AND METHOD FOR PRODUCING THE SAME

BACKGROUND OF THE INVENTION

1. Field of the Invention

The present invention relates to an electric contact and a method for producing the same. More particularly, the present invention relates to an electric contact of, for example, an electric wiring terminal, a relay or a switch used in an automobile, an industrial apparatus and the like, in particular, an electric contact which is used in a field where a long-term deterioration will be a problem or a use temperature is expected to rise, and a method for producing such electric contact.

2. Description of the Related Art

In an electric circuit, parts of a pair of conductors to be electrically connected, namely electric contacts should satisfy various property requirements. Among them, important ones are a low contact resistance, a high melting point, good resistance to fusing, and the like. When the electric contact is used for a long time and exposed to wind and rain or a high temperature or when it is required to have high reliability, it should be highly resistant to corrosion, abrasion and heat.

Hitherto, a terminal fitment to be used in an automobile or an industrial apparatus utilizes an electric contact made of a copper alloy such as brass, phosphor bronze or, in some cases, stainless steel or an electric contact made of copper or a copper alloy a surface of which is plated with tin or nickel. In a computer control circuit in which breakage should be avoided and through which a very weak current passes, an electric contact made of stainless steel plated with gold is used.

The copper alloy electric contact is cheap but poor in resistance to oxidation, so that, after long-term use, it is oxidized and its contact resistance increases.

The copper or copper alloy electric contact plated with tin or nickel has better oxidation resistance than the copper alloy electric contact but a relatively high contact resistance. In addition, it has poor resistance to chemicals.

The gold-plated electric contact is excellent in oxidation resistance and corrosion resistance and its contact resistance is stable at room temperature. Therefore, it is widely used in the fields where high reliability is required. However, when a pure gold plating is heated to a temperature of 90° C. or higher, its adhesion and cohesion increase, so that it tends to be easily abrased by an opposite conductor to which it is contacted. In case of a gold plating which is hardened with an impurity, the impurity separates out onto the surface from grain boundaries and the contact resistance increases. Then, the gold plated electric contact has poor heat resistance. Further, gold is expensive.

Although stainless steel which is often used as a base material for gold plated electric contact has no problem in heat resistance, its resistivity is large, for example, about 70 $\mu\Omega$.cm in case of SUS 304. Further, since a surface of stainless steel has a passive state chromium oxide layer, the contact resistance is large.

When a pair of conductors to be electrically connected are made of different metals, electric erosion occurs between them in each case where the conductors are those of the electric contact which are contacted and separated or where they are connecting terminals which are fixed together.

The electric erosion occurs when water or other liquid penetrates between a pair of different metals to be contacted and a more base metal is dissolved from its contacted surface in water or the liquid due to a difference of corrosion potentials between the metals.

A combination of different metals is seen when an electric part or a body of an automobile or an air craft is made of a light aluminum material in view of a recent requirement for light weight while a cheap copper base material is used as an electrically conductive material, for example, when a grounding terminal made of a copper base material is connected to an aluminum body of an automobile. Since aluminum is a base metal, it almost always suffers from electric erosion if the terminal to be connected thereto is not made of aluminum.

Hitherto, to prevent the electric erosion at the contacting part between the different metals, the corrosion potential between the contacted metals is lowered to suppress the electric erosion by using a tin-plated copper alloy as a material of the copper base material so as to interpose a tin layer between the different metals. Alternatively, the contacting part of the different metal is sealed with a resin to prevent penetration of water or other liquid which causes the electric erosion into the contacting part.

When the metal material plated with, for example, tin is used, an amount of electric erosion can be reduced but the occurrence of electric erosion cannot be perfectly prevented. When the contacting part of the different metals is used in an corrosive atmosphere where deposition of moisture such as condensation caused by change of environmental conditions and used in a part which requires long term durability, for example, an automobile electrical part, an amount of electric erosion is not negligible. Further, the electrical material made of copper or a copper alloy, a surface of which is plated with tin or nickel, has better oxidation resistance than the copper alloy as such but it has relatively high contact resistance and poor resistance to chemicals.

When the contacting part of the different metals is sealed with the resin to prevent penetration of water, a presently used water-resistant resin has poor wettability with the metal so that the penetration of water at an interface between the metal and the resin cannot be completely prevented, and therefore the occurrence of electric erosion cannot be prevented. When a pair of the conductors are usually separated and contacted at the time of functioning, the conductors cannot be sealed with the resin.

SUMMARY OF THE INVENTION

One object of the present invention is to provide an electric contact which is excellent in oxidation resistance, corrosion resistance and heat resistance and has a low and stable contact resistance even when exposed to high temperature and further which is cheap.

Another object of the present invention is to provide an electric contact having, at a part of a support metal where a conductor is contacted, a coating layer to impart oxidation resistance, corrosion resistance and heat resistance, which contact less suffers from cracking or peeling of the coating layer due to physical shock, thermal shock and/or deformation.

A further object of the present invention is to provide a method for producing an electric contact having a conductive ceramic layer thereon.

A yet another object of the present invention is to provide an electric contact which can prevent electric erosion of a connecting part of different metals and provides a connection with improved environment resistance.

According to a first aspect of the present invention, there is provided an electric contact which is provided on at least one of a pair of conductors and a surface of which is coated with a ceramic layer comprising at least one material selected from the group consisting of nitrides, carbides and boride of high melting point metals.

According to a second aspect of the present invention, there is provided an electric contact which is provided on at least one of a pair of conductors and a surface of the electric contact being coated with a metal layer comprising a high melting point metal or an alloy of a high melting point metal and, on said metal layer, a ceramic layer comprising at least one material selected from the group consisting of nitrides, carbides and boride of high melting point metals.

According to a third aspect of the present invention there is provided a method for producing an electric contact which is provided on at least one of a pair of conductors and a surface of the electric contact being coated with a metal layer comprising a high melting point metal or an alloy of a high melting point metal and, on said metal layer, a ceramic layer comprising at least one material selected from the group consisting of nitrides, carbides and boride of high melting point metals, which method comprises steps of:

sputter etching a surface of said at least one conductor in a first reaction chamber which is kept at a reduced pressure, moving said sputter etched conductor to a second reaction chamber which is connected with said first reaction chamber through a connecting hole and kept at a pressure lower than that in said first chamber, forming a metal layer comprising a high melting point metal or an alloy of a high melting point metal on said sputter etched surface of said conductor by a vapor phase deposition method, moving said conductor having said metal layer thereon in the previous step to a third reaction chamber which is connected with said second chamber through a connecting hole and kept at a pressure lower than that in said second reaction chamber, and forming a ceramic layer comprising at least one material selected from the group consisting of nitrides, carbides and boride of high melting point metals on said metal layer formed on said conductor.

According to a fourth aspect of the present invention, there is provided an electric contact which is provided on one of a pair of conductors made of different metals the metal of the one conductor being more base than that of the other conductor a surface of the electric contact being coated with a ceramic layer comprising at least one material selected from the group consisting of nitrides, carbides and boride of high melting point metals.

According to a fifth aspect of the present invention, there is provided an electric contact which is provided on at least one of a pair of conductors and a surface of which is coated with a ceramic layer comprising at least one material selected from the group consisting of nitrides, carbides and borides of high melting point metals and, on said ceramic layer, a metal layer comprising at least one noble metal selected from the group consisting of Au, Pt, Pd, Ru, Ir and Os. This electric contact may have a further metal layer comprising a high melting point metal or an alloy of a high melting point metal between the conductor and the ceramic layer.

DETAILED DESCRIPTION OF THE INVENTION

Figure 1:
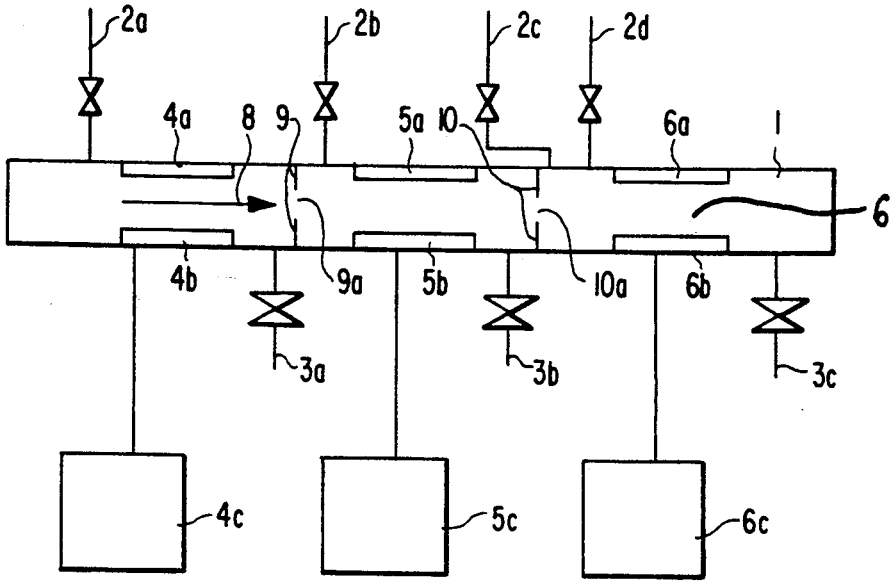
FIG. 1 schematically shows an example of an apparatus for carrying out the method of the present invention.

In the present invention, the term "high melting point metal" has the same meaning as used in a semiconductor process field and includes most of metals having a melting point which is substantially the same as or higher than that of polycrystalline silicon. Specific examples of the high melting point metal are Mo, W, Ta, Hf, Zr, Nb, Ti, V, Re, Cr, Pt, Ir, Os and Rh. Among them, Ti, Zr, Hf, Ta, W and Mo are preferred in the present invention. The high melting point metals can be used independently or as a mixture of two or more.

Examples of ceramic to be used for forming the ceramic layer are nitrides, carbides and boride of the above high melting point metals.

The resistivities of typical conductive ceramics to be used in the present invention are as follows:

| Ceramic | Resistivity ($\mu\Omega$.cm) |
|---|---|
| TiN | 40 |
| ZrN | 30 |
| VN | 100 |
| TaN | 130 |
| ZrC | 100 |
| TaC | 60 |
| WC | 60 |
| $TiB_2$ | 30 |
| $ZrB_2$ | 20 |
| $HfB_2$ | 20 |
| CrB | 100 |

In the ceramic layer, a content of nitrogen, carbon or boron may have a gradient such that the content increases towards the outer surface of the layer.

In the electric contact of the first aspect, the ceramic layer has preferably a thickness of about 50 nm to about 1 $\mu$m. With such thickness, the resistance of the ceramic layer can be made negligibly small in comparison with the contact resistance.

The electric contact of the second aspect has a metal layer between the conductor surface and the ceramic layer, which metal layer comprises at least one of the above high melting point metals or their, alloys. A kind of the metal may be the same as or different from that contained in the ceramic layer.

In this electric contact, the metal layer has a thickness of about 50 nm to about 2 μm, and the ceramic layer has a thickness of about 20 nm to about 500 nm. With such thickness of the ceramic layer, the resistance of the ceramic layer can be made negligibly small in comparison with the contact resistance.

Since the ceramic is chemically stable, its elements and the metal element of the conductor do not diffuse each other so that the adhesivity between the conductor and the ceramic may be weak. In addition, since the ceramic has a much larger hardness (1000 to 3000 Hv) than the conductor metal, the ceramic layer tends to be cracked or peeled off by the physical shock. The metal layer of the second aspect of the present invention increases the adhesivity between the ceramic layer and the conductor metal. As the result, the cracking or peeling off of the ceramic layer can be prevented. In addition, when the electric contact is expanded and contracted repeatedly by heating-cooling cycles, the ceramic layer is not cracked or peeled off because of the presence of the metal layer.

The presence of the metal layer does not materially deteriorate the characteristics of the ceramic layer. A growing rate of the metal layer by the vapor deposition is 5 to 10 times larger than that of the ceramic layer. Therefore, the productivity of the electric contact is increased. In addition, the presence of the metal layer decreases the contact resistance.

When a pair of the conductors are made of different metals, the electric contact of the present invention is preferably provided on a conductor made of a metal which is more base than the other.

In this case, the thickness of the ceramic layer is the same as in the above second aspect of the present invention.

In one embodiment of the present invention, the ceramic layer on one conductor may be further coated with a metal which constitutes the other conductor or its alloy.

In another embodiment of the present invention, the electric contacts of the present invention are provided on both conductors to be connected.

In a preferred embodiment, the electric contact of the present invention further has a layer of a noble metal on the ceramic layer. Examples of the noble metal is Au, Pt, Pd, Ru, Ir and Os and mixtures thereof.

The noble metal layer has a thickness of about 50 nm to about 100 nm.

The optional metal layer, the ceramic layer and the optional noble metal layer may be formed by any of conventional vapor phase deposition methods such as sputtering, vacuum evaporation, ion plating and CVD. Among them, sputtering is preferred.

In the process of the third aspect of the present invention, the conductor material is sputter etched in the first reaction chamber which is kept at a reduced pressure to remove a naturally formed oxide film on the conductor surface. This removal step will make it easy to diffuse the metal of the metal layer into the conductor or to diffuse the conductor metal into the metal layer.

The second reaction chamber is connected with the first reaction chamber via the connecting hole and the pressure in the second chamber is lower than that in the first chamber. Through the connecting hole, the sputter etched conductor is conveyed from the first reaction chamber to the second reaction chamber, whereby, reoxidation of the conductor surface is prevented.

In the second reaction chamber, the high melting point metal or its alloy is deposited on the conductor surface by the vapor phase deposition method. Since the pressure in the second reaction chamber is lower than that in the first reaction chamber, atoms or molecules generated in the second reaction chamber for the formation of the metal layer do not diffuse into the first reaction chamber.

After the formation of the metal layer, the conductor is conveyed from the second reaction chamber to the third reaction chamber. The third reaction chamber is connected with the second reaction chamber via the connecting hole and the pressure in the third chamber is lower than that in the second chamber. Through the connecting hole, the conductor carrying the formed metal layer is conveyed from the second reaction chamber to the third reaction chamber, whereby, oxidation of the metal layer is prevented.

In the third reaction chamber, the ceramic layer is formed on the metal layer. Since the pressure in the third reaction chamber is lower than that in the second reaction chamber, contamination of the second reaction chamber by reactive gasses for the formation of the ceramic is prevented, and the formation of the metal layer in the second chamber is not interfered by the reactive gasses in the third chamber. In addition, when the high melting point metal component in the ceramic is the same as that of the metal layer, for example, when Ti and TiN or Ta and TaC are used, the metal particles in the second reaction chamber flow into the third reaction chamber, whereby the content of the metal in the ceramic continuously changes from high to low.

The above method of the present invention will be explained further in detail by making reference to the accompanying drawing.

FIG. 1 schematically shows an example of an apparatus for carrying out the above method of the present invention.

In this apparatus, a conductor 8 is conveyed from the left side to the right side of a chamber 1. The chamber 1 can be sealed to prevent the inflow of air. The interior of the chamber 1 is partitioned by two walls 9 and 10 to form three sub-chambers, namely an etching chamber 4, a metal layer-forming chamber 5 and a ceramic layer-forming chamber 6 from left to right in FIG. 1. The walls 9 and 10 have respective connecting holes 9*a* and 10*a* through which the conductor 8 is passed. Accordingly, three sub-chambers are connected through the holes 9*a* and 10*a*. To each of the sub-chambers, a gas inlet tube 2*a*, 2*b* or 2*c* having a valve is provided for introducing argon. Each of the sub-chambers has an evacuation tube 3*a*, 3*b* or 3*c* having a valve. The valves are automatically opened and closed by controlling equipment (not shown).

On upper and lower walls of the etching chamber 4, electrodes 4*a* and 4*b* are provided, respectively. Between these electrodes, direct current discharge is generated by a direct current source 4*c*.

On upper and lower walls of the metal layer-forming chamber 5, targets 5*a* and 5*b* made of a high melting point metal are provided, respectively. Between the targets 5*a* and 5*b*, discharge is generated by a power source 5*c*. The power source 5*c* may be a direct current one or a high frequency wave one according to the kind of the metal.

Similarly, on upper and lower walls of the ceramic layer-forming chamber 6, targets 6a and 6b made of a high melting point metal are provided, respectively, and between the targets 6a and 6c, discharge is generated by a direct current or high frequency wave power source 6c. In addition, a gas inlet tube 2d for introducing nitrogen is connected to the ceramic layer-forming chamber 6.

The production steps for the formation of the electric contact of the present invention with the above apparatus will now be explained.

The pressure in each of the etching chamber 4, the metal layer-forming chamber 5 and the ceramic layer-forming chamber 6 is suitably adjusted by independently exhausting and introducing a gas. The pressure is lowest in the ceramic layer-forming chamber 6 and next in the metal layer-forming chamber 5 and highest in the etching chamber 4.

The conductor 8 is passed between the electrodes 4a and 4b and sputter etched by, for example, generated argon ions, whereby the naturally formed oxide film is removed.

Then, the conductor 8 is conveyed from the etching chamber 4 to the metal layer-forming chamber 5 through the hole 9a and passed between the targets 5a and 5b to sputter deposit the metal. That is, by the irradiation of the argon ions onto the targets, the liberated metal particles are deposited on the conductor 8.

The conductor 8 carrying the formed metal layer is conveyed from the metal layer-forming chamber 5 to the ceramic layer-forming chamber 6 through the hole 10a.

The ceramic layer-forming chamber 6 is maintained at a pressure lower than that in the metal layer-forming chamber 5 and supplied with a nitrogen gas. The conductor 8 is passed between the targets 6a and 6b in the chamber 6, during which, particles of nitride of the high melting point metal which is formed and liberated by the irradiation of the nitrogen ions are formed on the metal layer on the conductor 8.

For example, using a brass plate having a thickness of 0.2 mm as the conductor and Ti as the high melting point metal, the metal layer and the ceramic layer were formed on the conductor.

The pressures of the etching chamber, the metal layer-forming chamber and the ceramic layer-forming chamber were controlled at 20 mmTorr, 10 mmTorr and 5 mmTorr, respectively. After sputter etching the brass plate, a Ti layer having a thickness of about 100 nm was formed on the brass plate and then a TiN layer having a thickness of about 200 nm was formed on the Ti layer. The brass plate having the Ti layer and the TiN layer was bent with a radius of 4 mm. The ceramic layer was not peeled off.

When a carbon source compound such as methane or a boron source compound is used in place of nitrogen in the ceramic layer-forming chamber, carbide or boride of the high melting point metal is deposited on the metal layer.

The above ceramic layer forming procedure can be applied to the formation of the ceramic layer of all the electric points of the present invention.

When an area of the connection hole 10a between the metal layer-forming chamber 5 and the ceramic layer-forming chamber 6 is enlarged, the ceramic layer formed near the metal layer-forming chamber 5 contains a relatively large amount of the high melting point and a relatively lower amount of ceramic. As the conductor leaves the metal layer-forming chamber 5, the content of the high melting point metal decreases while the content of ceramic increases. Thereby, the ceramic layer has a gradient composition from the large content of the high melting point metal to the large content of the ceramic. When the ceramic layer has such gradient composition, there is no clear boundary between the metal layer and the ceramic layer so that the ceramic layer is firmly adhered to the conductor. Therefore, the electric contact having such ceramic layer is very appropriate as an electric contact which tends to suffer from mechanical shock or thermal shock.

PREFERRED EMBODIMENTS OF THE INVENTION

Example 1

Figure 2:
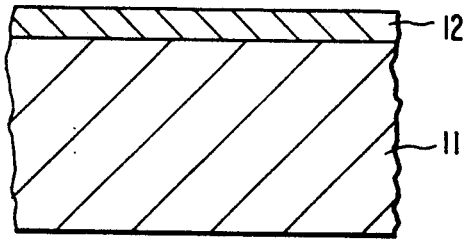
FIG. 2 shows a cross section of an electric contact according to a first aspect of the present invention.

On a brass conductor surface, a TiN layer having a thickness of about 300 nm was formed by sputtering. FIG. 2 shows a cross section of a produced electric contact which consisted of a brass conductor 11 and a TiN layer 12.

The contact resistance (Ω) of the electric contact was measured at room temperature under varying contact load. With an electric contact consisting of a brass plate which was plated with tin or gold, the contact resistance was also measured. The results are shown in Table 1.

TABLE 1

| Contact material | Load | | | | | | |
|---|---|---|---|---|---|---|---|
| | 1.0 g | 2.0 g | 5.0 g | 10 g | 20 g | 50 g | 100 g |
| TiN | 0.75 | 0.27 | 0.079 | 0.032 | 0.016 | 0.008 | 0.006 |
| Au | 0.028 | 0.026 | 0.023 | 0.020 | 0.016 | 0.012 | 0.011 |
| Sn | 4.58 | 4.56 | 1.92 | 0.750 | 0.237 | 0.042 | 0.019 |

The electric contact having the TiN layer and the tin or gold plated electric contact were heated at 200° C. for 2 hours in air and then their contact resistance was measured under varying contact load. The results are shown in Table 2.

TABLE 2

| Contact material | Load | | | | | | |
|---|---|---|---|---|---|---|---|
| | 1.0 g | 2.0 g | 5.0 g | 10 g | 20 g | 50 g | 100 g |
| TiN | 29.96 | 2.97 | 0.90 | 0.57 | 0.281 | 0.074 | 0.021 |
| Au | >20.76 | 8.11 | 0.17 | 0.042 | 0.020 | 0.010 | 0.007 |
| Sn | >69.30 | >53.45 | >25.49 | 2.26 | 0.783 | 0.194 | 0.091 |

From the above results, it is understood that the contact resistance of the electric contact having the TiN layer is larger than that of the gold plated electric contact but smaller than that of the tin plated electric contact when the contact load is small. As the contact load increases, the contact resistance of the electric contact having the TiN layer decreases and becomes substantially the same as that of the gold plated electric contact. After the heat treatment, under the small contact load, the electric contact having the TiN layer has a smaller contact resistance than the gold plated electric contact.

The cost of the formation of the TiN layer is only about 30 to 50% of the gold plating. The electric contact having the TiN layer can be used, under the large contact load, between the gold plated electric contact and the tin plated electric contact and, under the small contact load, as an electric contact having better heat resistance than the gold plated electric contact.

Figure 4:
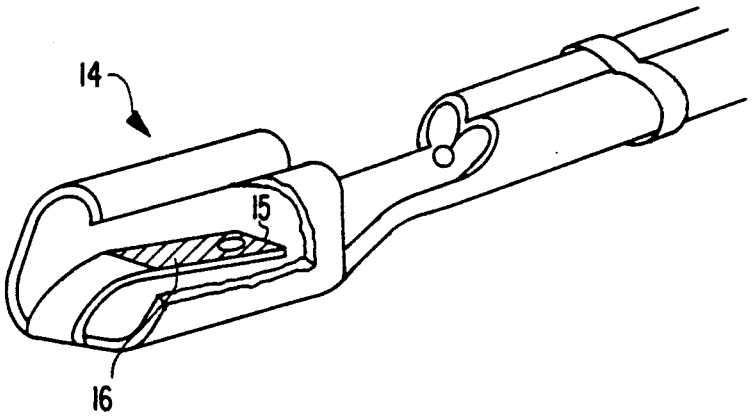
FIG. 4 shows a female terminal of a connector in which an electric contact of the present invention is preferably used.

In view of the above characteristics, the electric contact having the TiN layer is suitably used in a detachable connector having a pair of terminals. FIG. 4 shows a female terminal 14 of such connector, in which, a contacting area 15 of the female terminal and an area surrounding it are coated with the TiN layer 16.

Example 2

Figure 3:
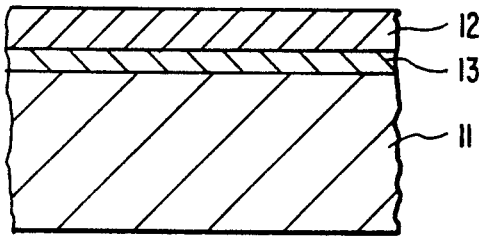
FIG. 3 shows a cross section of an electric contact according to a second aspect of the present invention.

On a surface of a brass plate having a thickness of 0.2 mm, a Ti layer having a thickness of about 100 nm was formed by sputtering and then, on the Ti layer, a TiN layer having a thickness of about 200 nm was formed by sputtering. FIG. 3 shows a cross section of a produced electric contact which consisted of a brass conductor 11, a Ti layer 13 and a TiN layer 12.

On a surface of a brass plate having a thickness of 0.2 mm, only a TiN layer having a thickness of about 300 nm was formed by sputtering.

The brass plate having the Ti layer and the TiN layer and the brass plate having only the TiN layer were bent with a radius of 4 mm. In the latter, about 100 minute spot-form peelings per one $mm^2$ were generated, while in the former, no peeling was observed.

When the inner layer of 100 to 200 nm of the above TiN layer having the thickness of 300 nm is replaced with the Ti layer, the contact resistance is decreased to 10 to 50% of the original value. The increasing rate of the contact resistance of such Ti-replaced electric contact with the temperature increase is substantially the same as the electric contact having only the TiN layer.

The deposition rate of the Ti layer is 5 to 10 times larger than that of the TiN layer.

The contact resistance of the electric contact having the Ti layer and the TiN layer showed the same change when the contact load was changed before and after heating. Therefore, the electric contact of Example 2 can be used in the connector of FIG. 4 like the electric contact of Example 1.

Examples of the electric contact which is provided on at least one of a pair of conductors made of different metals that is more base than the other will be explained by making reference to the accompanying drawings.

Figure 5:
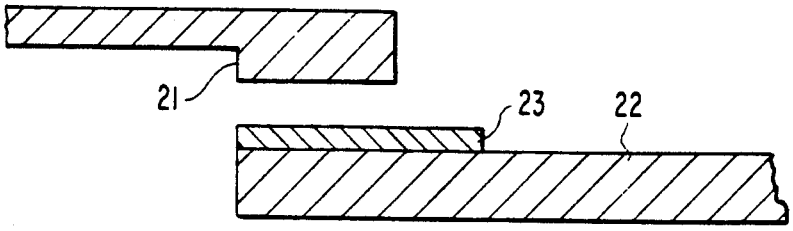
FIGS. 5 to 11 show first to seventh examples of an electric contact according to a fourth aspect of the present invention.

FIG. 5 shows a first example of such electric contact provided at a contacting area of a pair of conductors made of different metals, for example, copper or a copper alloy and aluminum or an aluminum alloy. The contact of FIG. 5 consists of a copper alloy contact 21 and an aluminum alloy contact base material 22, on a surface of which, a TiN conductive ceramic layer 23 is formed. The aluminum alloy contact base material 22 contacts with the copper alloy contact 21 through the ceramic layer 23.

Figure 6:
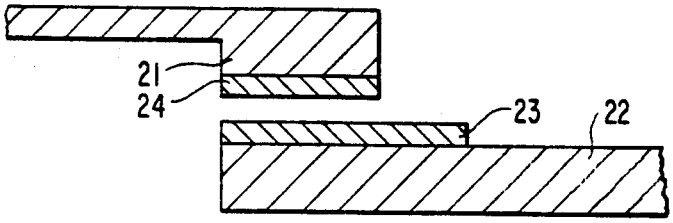

FIG. 6 shows a second example of such electric contact, in which both the copper alloy contact 21 and the aluminum alloy contact base material 22 are coated with the TiN conductive ceramic layers 24 and 23, respectively.

Figure 7:
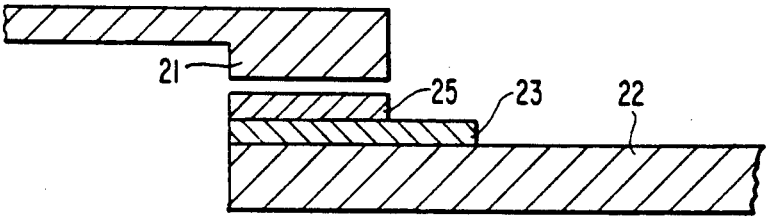

FIG. 7 shows a third example of such electric contact, in which a metal layer 25 made of the same copper alloy as the copper alloy contact 21 is coated on the TiN layer 23. The metal layer 25 has a thickness of 1 to 10 μm.

When the metal layer 25 is provided on the surface of the TiN conductive ceramic layer 23, electric erosion of can be prevented by the metal layer 25 when the TiN conductive ceramic layer 23 has a pin hole or is cracked by shock.

Figure 8:
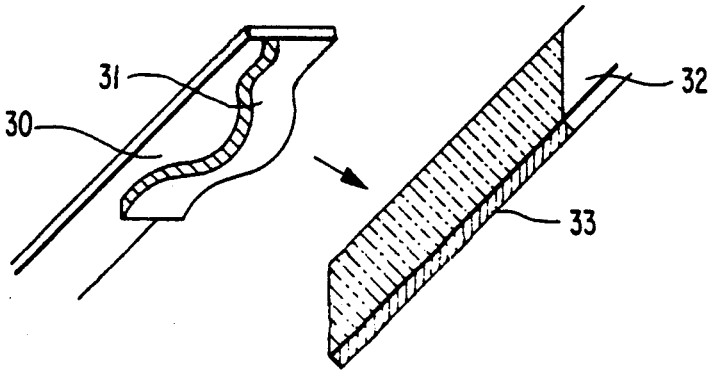

FIG. 8 shows a fourth example of such electric contact, in which one of a pair of the conductors is made of stainless steel having a passive oxide layer and the other is made of a copper alloy. When the passive oxide layer is present, the stainless steel is less corroded. However, when it is contacted with the different metal such as copper or a copper alloy, electric erosion occurs. In the combination of the stainless steel and copper, copper is more base than the stainless steel. Therefore, the copper side is coated with the conductive ceramic layer.

That is, in the fourth example, a snap-form terminal 31 is provided on a conductor 30 made of stainless steel having a passive oxide layer, while a TiN conductive ceramic layer 33 is formed on a contacting area of a conductor 32 made of a copper alloy.

All the electric contacts of the above first to fourth examples are contacted and separated by sliding or pressing the conductor(s). The present invention can be applied to a connecting terminal having a fixed contacting part.

Figure 9:
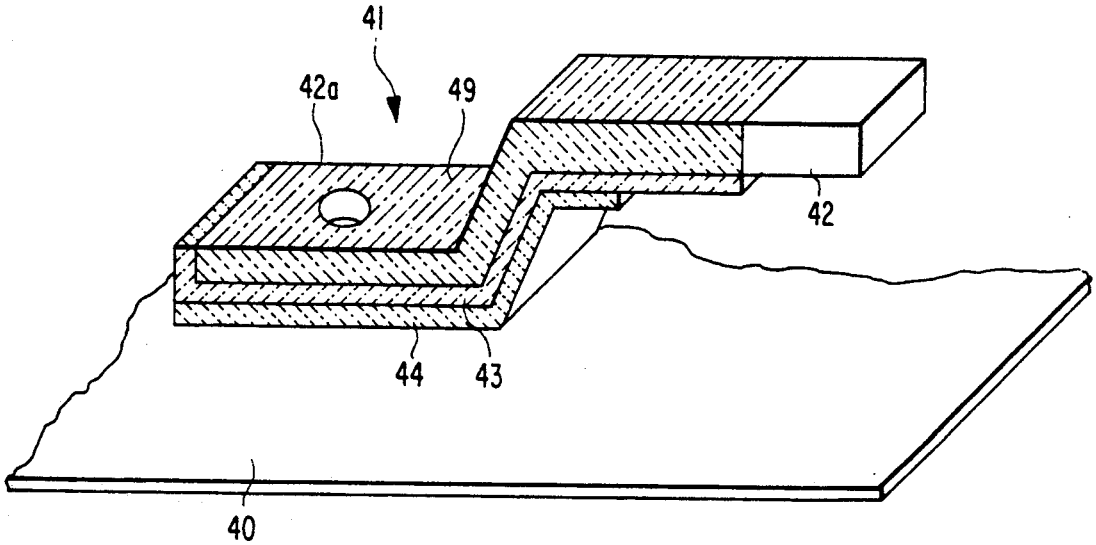

A fifth example of FIG. 9 has a fixed contacting part and is used for connecting a grounding terminal 41 made of copper or a copper alloy to an aluminum body 40 of an automobile. Since it is difficult to form the TiN conductive ceramic layer on a surface of the aluminum body 40, an aluminum layer is formed on an area of the grounding terminal 41 which contacts to the aluminum body 40. That is, the grounding terminal 41 has a shape as shown in FIG. 9 and has a TiN conductive ceramic layer 43 on a contacting part of a copper alloy base material 42 on the side **42*a* to be fixed to the aluminum body. Also, a surface of the non-contacting opposite side is coated with the TiN conductive ceramic layer 49. The surface of the TiN conductive ceramic layer 43 is coated with an aluminum layer 44. The grounding terminal 21 is fixed to the aluminum body 40 with contacting the aluminum layer 44 to the aluminum body 40** by mounting or welding or with a rivet (not shown).

Figure 10:
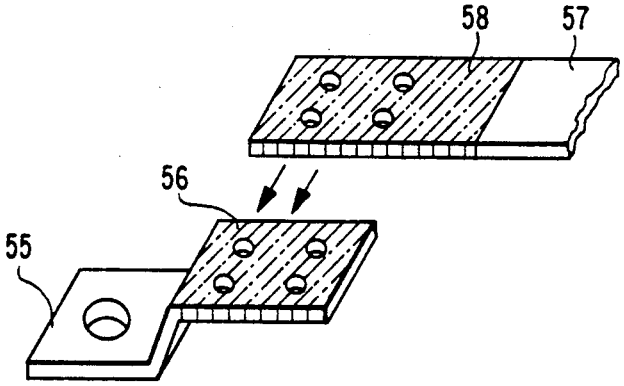

FIG. 10 shows a sixth example of a contact which is similar to the example of FIG. 9 and connects the grounding terminal to the aluminum body of the automobile. On the aluminum body, a body-fixing terminal, which is to be fixed to the body and made of a metal suffering no electric erosion, is fixed, and the grounding terminal is connected to the body-fixing terminal so that the connection of the different metals is converted to a connection between the terminals suffering no electric erosion. That is, the body fixing terminal 55 is made of the same kind metal as the aluminum body, namely aluminum or an aluminum alloy, and the whole surface of the body-fixing terminal 55 on the copper terminal fixing part side is coated with the TiN conductive ceramic layer 56. The whole surface of a fixing part of the copper alloy grounding terminal 57 is coated with the TiN conductive ceramic layer 58. The body-fixing terminal 55 is fixed to the aluminum body, and the grounding terminal 57 is fixed to the body-fixing terminal 55 with a rivet (not shown) and the like.

Figure 11:
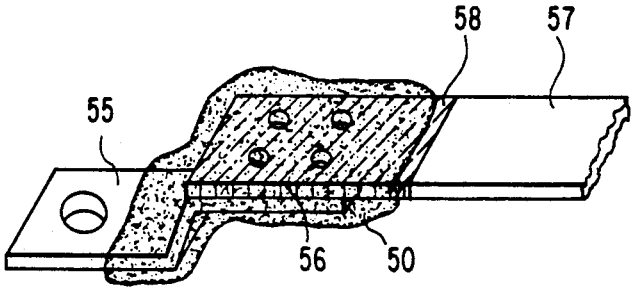

FIG. 11 shows a seventh example, which has the same structure as the example of FIG. 10 except that the contacted part between the body-fixing terminal 55 and the grounding terminal 57 are sealed with a water resistant resin 50. As already explained, the water resistant has poorer wettability with the metal, whereby, water penetrates in an interface between the resin and the metal and causes electric erosion or gap corrosion. Therefore, the sealing with the resin alone cannot prevent electric erosion. To prevent electric erosion, in this example, the surface of the terminal made of more base aluminum is coated with the TiN conductive ceramic layer and also the surface of the terminal made of electrically positive copper or the copper alloy is coated with the TiN conductive ceramic layer.

The structures of the above examples can be applied to a pair of conductors made of different metals, for example, titanium or a titanium alloy and aluminum or an aluminum alloy such as duralmine. This combination of the different metals is often found in an airplane field. In a connection of titanium and aluminum, an amount of electric erosion seems to be larger than in the combination of copper and aluminum in view of differences of normal electrode potentials. In the combination of titanium and aluminum, the more base metal is aluminum. Therefore, the TiN conductive ceramic layer is provided on at least a contacting part of an aluminum conductor. When a grounding terminal made of titanium is connected to the aluminum body of the airplane, since it is difficult to form the TiN conductive ceramic layer directly on the aluminum body, the TiN conductive ceramic layer is formed on the titanium grounding terminal and the aluminum layer is formed on the ceramic layer as in the above fifth example, and the titanium grounding terminal is connected to the aluminum body through the aluminum layer.

On the titanium surface, the TiN conductive ceramic layer may be formed by a well known ion implantation method or nitriding in a stream of a nitride gas or ammonium gas.

Example 3

In this Example, the occurrence of electric erosion in a connection between an aluminum conductor and a copper or copper alloy conductor was examined with or without the TiN conductive ceramic layer on the aluminum conductor.

As Sample 1, aluminum having no TiN conductive ceramic layer (A) and aluminum having the TiN conductive layer (B) were used. As Sample 2, copper (C), brass (D), copper having tin plating (E) and brass having the TiN conductive ceramic layer (F) were used.

Figure 12:
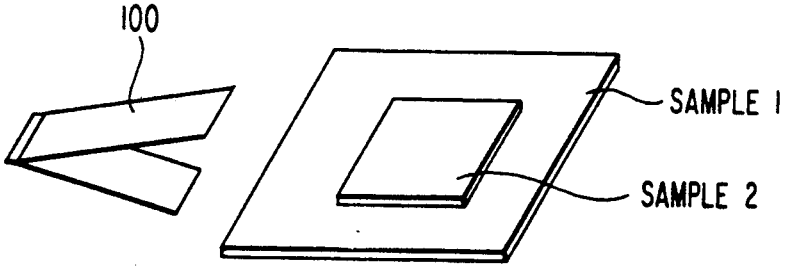
FIG. 12 is shows a way for forming a test sample to be tested in Example 3, FIG. 13 schematically shows a salt spray chamber used in Example 3.
Figure 13:
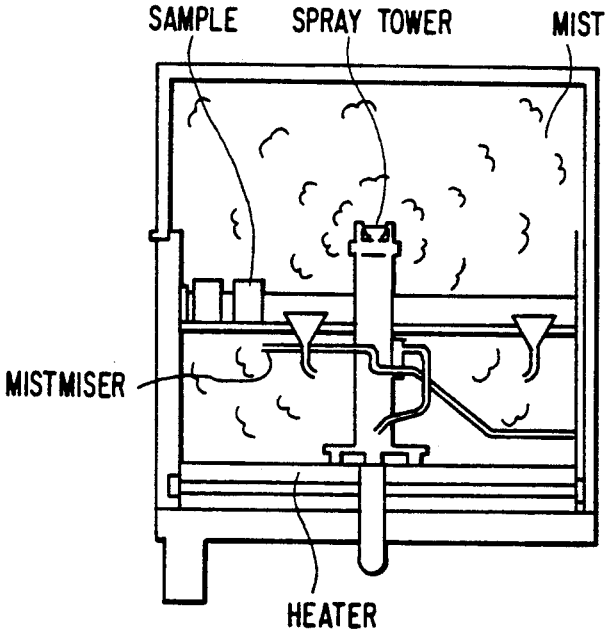

In the experiment, on the upper surface of the Sample 1, the Sample 2 is placed and clamped with a clip 100 as shown in FIG. 12 and placed in a salt spray test chamber with constant temperature and moisture shown in FIG. 13. The test chamber was maintained at 35° C. After spraying a 5% salt solution, the connected samples 1 and 2 were set in the test chamber for 120 hours. The results of the salt spray test are shown in Table 3.

TABLE 3

| Run | Sample 1 | | Sample 2 | | Weight change of Sample 1 (mg) |
|---|---|---|---|---|---|
| I | (A) | Al | (C) | Copper | −45.6 |
| II | (A) | ↑ | (D) | Brass | −42.9 |
| III | (A) | ↑ | (E) | Sn plated brass | −20.1 |
| IV | (A) | ↑ | (F) | Brass having a TiN layer | −41.1 |
| V | (B) | Al having TiN layer | (C) | Copper | −0.8 |
| VI | (B) | ↑ | (D) | Brass | −0.6 |
| VII | (B) | ↑ | (E) | Sn plated brass | −0.8 |
| VIII | (A) | ↑ | (F) | Brass having a TiN layer | −0.5 |

As seen from the results in Table 3, when the aluminum sample (A) having neither the TiN ceramic layer nor the plating was contacted to the copper or copper alloy sample (Run Nos. I and II), the weight of aluminum was greatly decreased, which indicates that aluminum easily suffers from electric erosion. When the copper alloy sample was plated with tin or coated with the TiN layer (Run Nos. III and IV), the weight loss of the aluminum sample was still large. This means that when the electrically positive metal only is plated or coated with the ceramic layer, the electric erosion of the base metal cannot be prevented.

When the aluminum sample coated with the TiN ceramic layer (A) was contacted to each of copper, brass, tin-plated brass and TiN-coated brass (Run Nos. V, VI, VII and VIII), the weight of the Sample 1 was not materially changed, which confirms that the electric erosion was prevented.

Figure 14:
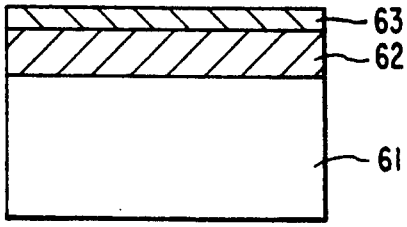
FIG. 14 shows a cross section of an electric contact according to a fifth aspect of the present invention.

An embodiment of the electric contact of the fifth aspect of the present invention is shown in FIG. 14, which comprises a copper alloy base plate 61, a conductive ceramic layer 62 formed on the base plate 61, and a noble metal layer 63 formed on the ceramic layer 62.

The ceramic layer 62 is formed by, for example, sputtering and has a thickness of 200 nm to 400 nm.

The noble metal layer 63 has a thickness of 50 to 100 nm.

Example 4

On a surface of a brass plate having a thickness of 0.3 mm, a TiN conductive ceramic layer was formed, and a surface of the ceramic layer was plated with gold to form a sample 1 according to the present invention.

For comparison, on the same brass plate, a nickel plating having a thickness of 1 μm and then a gold plating having a thickness of 0.3 μm were successively formed to form a sample 2 according the conventional technique.

The samples 1 and 2 were heated at 200° C. for 12 hours. The contact resistance before and after heating was measured. The results are shown in FIGS. 15 and 16, respectively.

Figure 15:
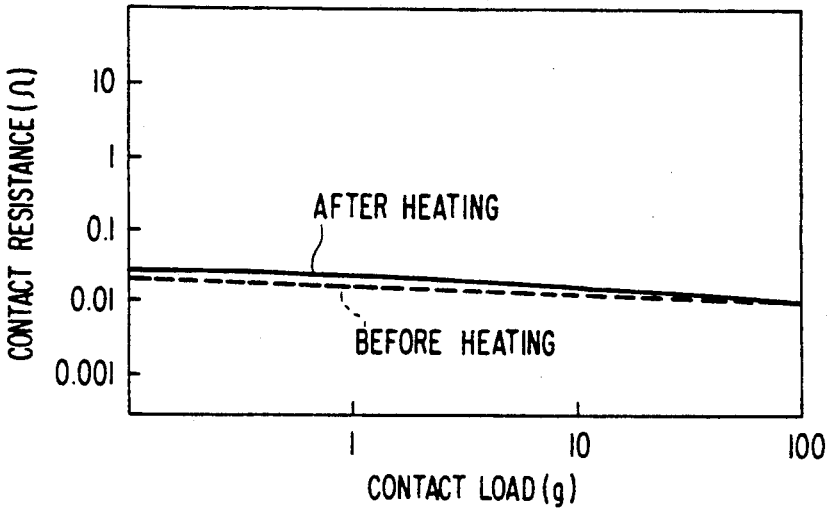
FIGS. 15 and 16 show graphs obtained in Example 4.
Figure 16:
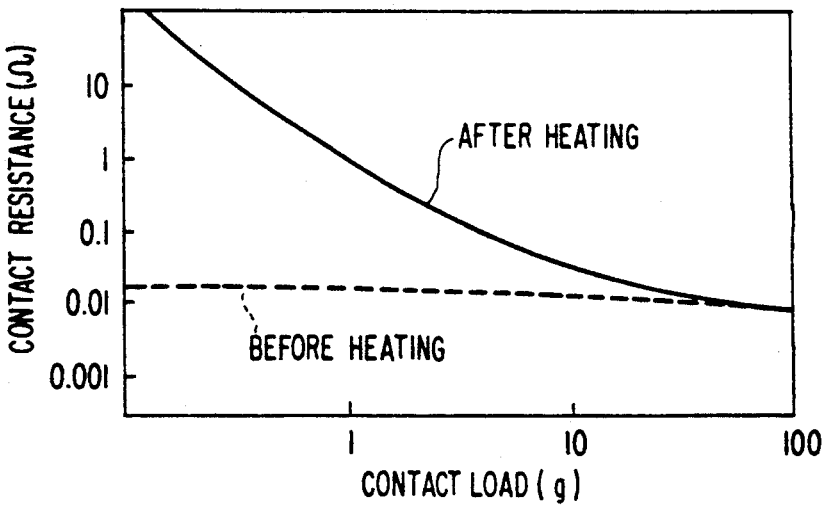

As understood from the graphs in FIGS. 15 and 16, both the samples 1 and 2 had low contact resistance before heating. After heating, the sample 1 had the stable contact resistance while the sample 2 had increased contact resistance under a load of 1 to 10 g.

After heating, the surfaces of the samples 1 and 2 were analyzed to find that oxides of nickel were formed on the surface of the sample 2. This is because the primer nickel diffused onto the surface and oxidized. The contact resistance of the sample 2 after heating may be increased by such oxidation. On the contrary, the sample 1 of the present invention was not changed by the above heating and had stable heat resistance in comparison with the sample 2.

Comparing the samples 1 and 2 before heating, the sample 1 having the gold layer of 0.1 μm in thickness had substantially the same contact resistance as the sample 2 having the gold layer of 0.3 μm in thickness. That is, to achieve the same contact resistance, the presence of the TiN ceramic layer reduces the thickness of the gold layer to one third of that required in case of the nickel plating.

As explained above, after heating, the contact resistance of the sample 2 greatly increased when the contact load decreased, while the sample 1 had stable contact resistance. From these results, it is confirmed that the combination of the TiN ceramic layer with the thin gold layer can maintain the more stable and lower contact resistance and better environment resistance than the combination of the nickel plating and the thick gold layer.

What is claimed is:

1. An electric contact which is provided on at least one of a pair of conductors and a surface of said electric contact being coated with a ceramic layer comprising at least one material selected from the group consisting of nitrides, carbides and borides of high melting point metals.

2. The electric contact according to claim 1, wherein said high melting point metal is at least one metal selected from the group consisting of Ti, Zr, Hf, Ta, W and Mo.

3. The electric contact according to claim 1, wherein said ceramic layer has a thickness of 50 nm to 1 μm.

4. An electric contact which is provided on at least one of a pair of conductors and a surface of said electric contact being coated with a metal layer comprising a high melting point metal or an alloy of a high melting point metal and, on said metal layer, a ceramic layer comprising at least one material selected from the group consisting of nitrides, carbides and borides of high melting point metals.

5. The electric contact according to claim 4, wherein said high melting point metal in said ceramic is at least one metal selected from the group consisting of Ti, Zr, Hf, Ta, W and Mo.

6. The electric contact according to claim 4, wherein said metal layer comprises Ti and said ceramic layer comprises TiN.

7. The electric contact according to claim 4, wherein said ceramic layer has a thickness of 20 nm to 500 nm.

8. The electric contact according to claim 4, wherein said ceramic layer includes an outer surface and has a gradient component distribution such that a content of nitrogen, carbon or boron increases towards said outer surface.

9. An electric contact which is provided on one of a pair of conductors made of different metals, the metal of said one conductor being more base than the metal of the other conductor, a surface of at least said one conductor, the metal of which is more base than the metal of the other conductor, being coated with a ceramic layer comprising at least one material selected from the group consisting of nitrides, carbides and borides of high melting point metals.

10. The electric contact according to claim 9, which further comprises a layer which is formed on said ceramic layer and made of the same metal as that of the other conductor.

11. The electric contact according to claim 9, wherein said high melting point metal is at least one metal selected from the group consisting of Ti, Zr, Hf, Ta, W and Mo.

12. The electric contact according to claim 9, wherein said ceramic layer has a thickness of 200 to 400 nm.

13. An electric contact which is provided on at least one of a pair of conductors, a surface of said electric contact being coated with a ceramic layer comprising at least one material selected from the group consisting of nitrides, carbides and borides of high melting point metals and, on said ceramic layer, a metal layer comprising at least one noble metal selected from the group consisting of Au, Pt, Pd, Ru, Ir and Os.

14. The electric contact according to claim 13, further comprising a further metal layer comprising a high melting point metal or an alloy of a high melting point metal positioned between said electric contact and said ceramic layer.

15. The electric contact according to claim 13, wherein said ceramic layer has a thickness of 200 to 400 nm.

16. The electric contact according to claim 13, wherein said noble metal layer has a thickness of 50 to 100 nm.

17. The electric contact according to claim 13, wherein said high melting point metal is at least one metal selected from the group consisting of Ti, Zr, Hf, Ta, W and Mo.

* * * * *